US007717530B2

(12) United States Patent
Oshima

(10) Patent No.: US 7,717,530 B2
(45) Date of Patent: May 18, 2010

(54) LIQUID JET APPARATUS AND PRINTING APPARATUS

(75) Inventor: Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/351,472

(22) Filed: Jan. 9, 2009

(65) Prior Publication Data

US 2009/0195576 A1 Aug. 6, 2009

(30) Foreign Application Priority Data

Jan. 16, 2008 (JP) ..... 2008-006622

(51) Int. Cl.
*B41J 29/38* (2006.01)

(52) U.S. Cl. ..... 347/11; 347/10

(58) Field of Classification Search ..... 347/10, 347/11

See application file for complete search history.

(56) References Cited

U.S. PATENT DOCUMENTS

2002/0163458 A1* 11/2002 Jin ..... 341/152
2005/0231179 A1* 10/2005 Ishizaki ..... 323/234

FOREIGN PATENT DOCUMENTS

| | | |
|---|---|---|
| JP | 02-262705 | 10/1990 |
| JP | 05-199044 | 8/1993 |
| JP | 2005-065068 | 3/2005 |
| JP | 2005-329710 | 12/2005 |
| JP | 2006-025151 | 1/2006 |
| JP | 2007-168172 | 7/2007 |
| JP | 2007-190708 | 8/2007 |
| JP | 2008-049698 | 3/2008 |
| JP | 2008-087467 | 4/2008 |

* cited by examiner

*Primary Examiner*—Matthew Luu
*Assistant Examiner*—Brian J Goldberg
(74) *Attorney, Agent, or Firm*—Workman Nydegger

(57) ABSTRACT

A liquid jet apparatus of the invention includes a drive waveform generator that generates a drive waveform signal, a modulator that pulse-modulates the drive waveform signal so as to produce a modulated signal, a digital power amplification circuit that amplifies the power of the modulated signal so as to produce an amplified digital signal, and a low pass filter that smoothes the amplified digital signal so as to produce a drive signal. The digital power amplification circuit includes multiple stages of digital power amplifiers each including a pair of switching elements that are push-pull-connected. The amplified digital signal is a multi-value signal that reaches a larger number of steps of electric potentials than the number of digital power amplifiers.

11 Claims, 11 Drawing Sheets

LIQUID JET APPARATUS AND PRINTING APPARATUS

BACKGROUND

1. Technical Field

The present invention relates to a liquid jet apparatus that jets a little liquid through multiple nozzles so as to form a minute particle (dot) on a medium, and thus forms a predetermined letter or image, and a printing apparatus to which the liquid jet apparatus is adapted.

2. Related Art

In liquid jet type printing apparatuses to which a liquid jet apparatus is adapted, a drive signal which has the power thereof amplified by a power amplification circuit is applied to actuators such as piezoelectric elements so that liquid will be jetted out through nozzles. If an analog power amplifier including push-pull-connected transistors that are linearly driven is used to amplify the power of the drive signal, a large loss is produced and a large heat sink for heat radiation is needed. According to JP-A-2005-329710, a digital power amplifier is used to amplify the power of the drive signal, whereby the loss is minimized and the necessity of the heat sink is obviated.

As described in JP-A-2005-329710, when the digital power amplifier is used to amplify the power of the drive signal, a frequency component equivalent to a modulated signal that does not have the power thereof amplified has to be removed using a low pass filter. In order to fully remove the modulated-signal frequency component, a low pass filter exhibiting a frequency characteristic that is sharp enough to stably pass a drive waveform signal component and fully remove the modulated-signal frequency component, or in other words, a high-order low pass filter is needed. In this case, a electric potential difference between the terminals of a coil employed in the low pass filter increases, and a loss derived from hysteresis increases.

SUMMARY

An object of the invention is to provide a liquid jet apparatus in which when a digital power amplifier is used to amplify a power, the order of a low pass filter can be decreased and a high-definition drive signal can be produced.

A liquid jet apparatus of the invention includes: a drive waveform generator that generates a drive waveform signal; a modulator that pulse-modulates the drive waveform signal so as to produce a modulated signal; a digital power amplification circuit that amplifies the power of the modulated signal so as to produce an amplified digital signal; and a low pass filter that smoothes the amplified digital signal so as to produce a drive signal. The digital power amplification circuit includes multiple stages of digital power amplifiers each composed of a pair of push-pull-connected switching elements. The amplified digital signal is a multi-value signal that reaches a larger number of steps of electric potentials than the number of digital power amplifiers.

In the invention, the power of the pulse-modulated signal is amplified by the digital power amplifiers in the multiple stages, and the outputs of the digital power amplifiers are combined in order to produce the amplified digital signal. The amplified digital signal becomes pulsating or stepwise. In the invention, the number of steps of electric potentials which the amplified digital signal reaches is the number of electric potentials which the pulsating or stepwise amplified digital signal reaches.

According to the liquid jet apparatus of the invention, the outputs of the digital power amplifiers in the multiple stages are combined in order to produce the amplified digital signal. The electric potential difference between steps of electric potentials which the amplified digital signal reaches is small. Therefore, the order of a low pass filter to be used to remove a frequency component equivalent to a modulated signal from the amplified digital signal can be lowered. When the amplified digital signal is a multi-value signal, a high-definition drive signal can be produced. By lowering the order of the low pass filter, circuitry can be simplified and downsized. In addition, since the electric potential difference between steps of electric potentials which the amplified digital signal reaches is small, the dielectric strength of the switching elements employed in the digital power amplifier can be decreased. This permits downsizing of the circuitry.

The liquid jet apparatus of the invention is characterized in that the digital power amplification circuit has a bootstrap circuit connected to the digital power amplifiers in the second or subsequent stage, and the digital power amplifier in a preceding stage applies a bias voltage.

According to the liquid jet apparatus of the invention, even when a consumed current remains unchanged, a supply voltage can be lowered. This permits downsizing of circuitry and power saving. Especially when the digital power amplifier in the preceding stage is energized and the digital power amplifier in the succeeding stage is de-energized, power is regenerated. Further power saving is permitted.

The liquid jet apparatus of the invention is characterized in that a capacitor employed in the bootstrap circuit has a capacitance which is large enough to drive actuators.

The liquid jet apparatus of the invention is characterized in that the digital power amplifiers in the multiple stages are connected to the same power supply.

The liquid jet apparatus of the invention is characterized in that the digital power amplifiers in the multiple stages are connected to power supplies at which different voltage are developed.

The liquid jet apparatus of the invention is characterized in that the modulator outputs the same number of modulated signals as the number of digital power amplifiers in the multiple stages.

The liquid jet apparatus of the invention is characterized in that the modulator is a pulse-width modulation circuit.

The liquid jet apparatus of the invention is characterized in that the modulator is a pulse-density modulation circuit.

DESCRIPTION OF EXEMPLARY EMBODIMENTS

Next, the first embodiment of a liquid jet type printing apparatus to which a liquid jet apparatus of the invention is adapted will be described below.

Figure 1A:
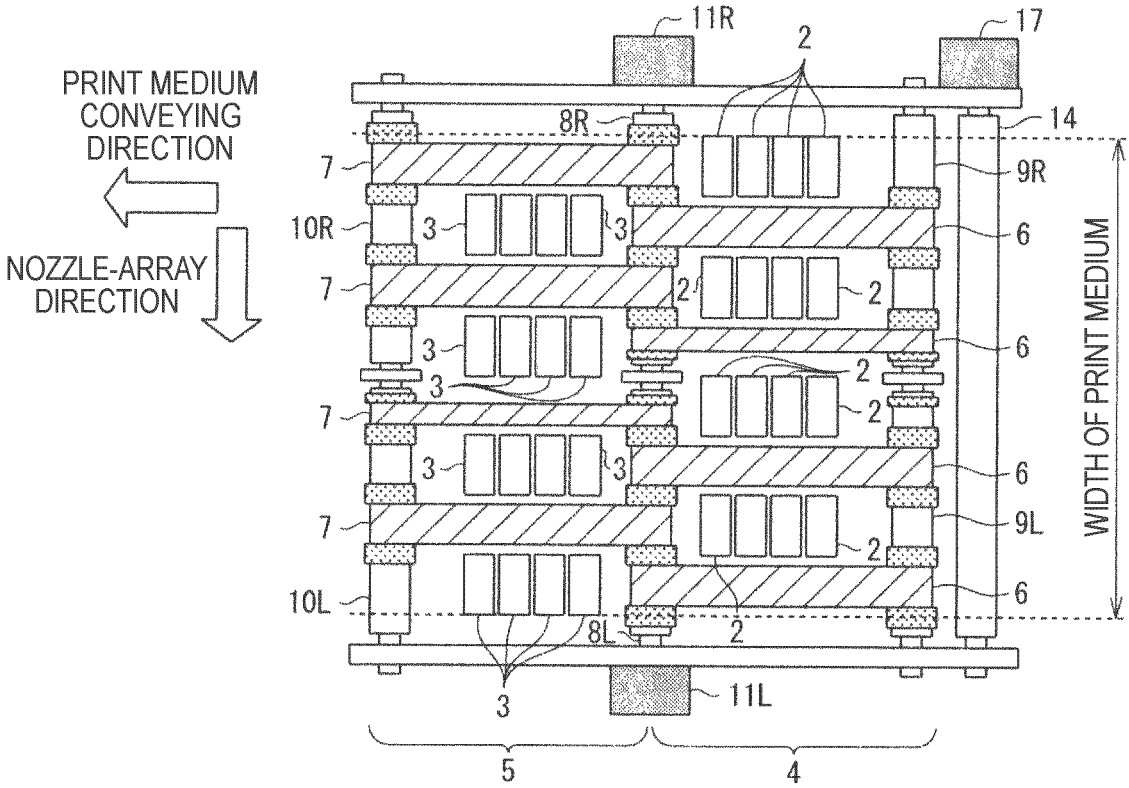
FIG. 1A is a plan view of the outline construction of a liquid jet type printing apparatus to which a liquid jet apparatus of the invention is adapted.
Figure 1B:
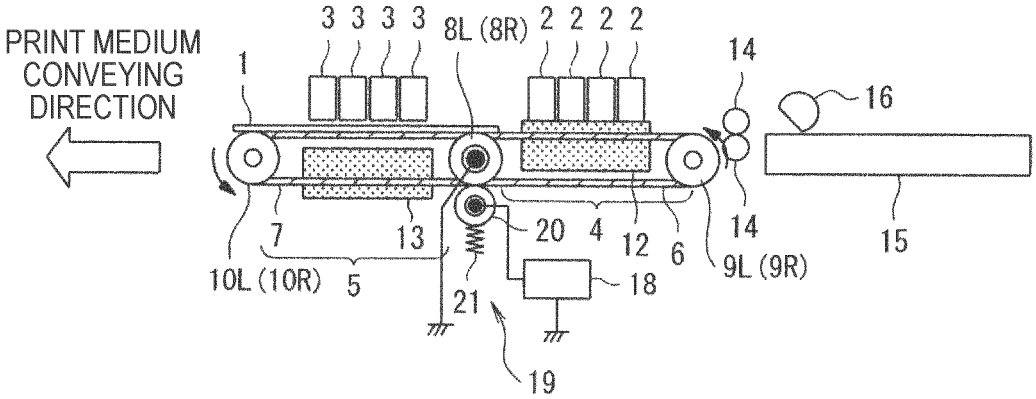
FIG. 1B is a front view of the outline construction of the liquid jet type printing apparatus to which the liquid jet apparatus of the invention is adapted.

FIG. 1A and FIG. 1B are schematic construction diagrams of the liquid jet type printing apparatus of the first embodiment. FIG. 1A is a plan view, and FIG. 1B is a front view. In FIG. 1A and FIG. 1B, a print medium 1 is conveyed in an arrow direction from right to left in the drawing, and printing is performed in a printing field in the middle of the conveyance. Thus, the liquid jet type printing apparatus may be referred to as a line head type printing apparatus.

Reference numeral 2 denotes a first liquid jet head disposed on the upstream side of a conveying direction in which the print medium 1 is conveyed. Reference numeral 3 denotes a second liquid jet head disposed on the downstream side thereof. A first conveying section 4 that conveys the print medium 1 is disposed below the first liquid jet heads 2, and a second conveying section 5 is disposed below the second liquid jet heads 3. The first conveying section 4 includes four first conveying belts 6 arranged with a predetermined space between adjoining belts in a direction intersecting the print medium 1 conveying direction (hereinafter, may be referred to as a nozzle-array direction). The second conveying section 5 includes four second conveying belts 7 arranged with a predetermined space between adjoining belts in the direction (nozzle-array direction) intersecting the print medium 1 conveying direction.

The four first conveying belts 6 and four second conveying belts 7 are juxtaposed to alternately adjoin each other. In the first embodiment, among the conveying belts 6 and 7, two first conveying belts 6 and two second conveying belts 7 on the right side of the nozzle-array direction, and two first conveying belts 6 and two second conveying belts 7 on the left side of the nozzle-array direction are discriminated from each other. Namely, a right-side driving roller 8R is disposed at the meeting position of the two first conveying belts 6 and two second conveying belts 7 on the right side of the nozzle-array direction, and a left-side driving roller 8L is disposed at the meeting position of the two first conveying belts 6 and two second conveying belts 7 on the left side of the nozzle-array direction. A right-side first driven roller 9R and a left-side first driven roller 9L are disposed on the upstream side beyond the driving rollers, and a right-side second driven roller 10R and a left-side second driven roller 10L are disposed on the downstream side beyond them. The pairs of rollers are seen continuous but are substantially discontinued in the center of FIG. 1*a*.

The two first conveying belts 6 on the right side of the nozzle-array direction are wound about the right-side driving roller 8R and right-side first driven roller 9R, and the two first conveying belts 6 on the left side of the nozzle-array direction are wound about the left-side driving roller 8L and left-side first driven roller 9L. The two second conveying belts 7 on the right side of the nozzle-array direction are wound about the right-side driving roller 8R and right-side second driven roller 10R, and the two second conveying belts 7 on the left side of the nozzle-array direction are wound about the left-side driving roller 8L and left-side second driven roller 10L. A right-side electric motor 11R is connected to the right-side driving roller 8R, and a left-side electric motor 11L is connected to the left-side driving roller 8L.

When the right-side driving roller 8R is driven to rotate by the right-side electric motor 11R, the first conveying section 4 including the two first conveying belts 6 on the right side of the nozzle-array direction and the second conveying section 5 including the two second conveying belts 7 on the right side of the nozzle-array direction move synchronously with each other at the same speed. When the left-side driving roller 8L is driven to rotate by the left-side electric motor 11L, the first conveying section 4 including the two first conveying belts 6 on the left side of the nozzle-array direction and the second conveying section 5 including the two second conveying belts 7 on the left side of the nozzle-array direction move synchronously with each other at the same speed. However, when the rotating speeds of the right-side electric motor 11R and left-side electric motor 11L are different from each other, the conveying speeds on the right and left sides in the nozzle-array direction can be changed from each other. Specifically, when the rotating speed of the right-side electric motor 11R is larger than the rotating speed of the left-side electric motor 11L, the conveying speed on the right side of the nozzle-array direction gets larger than that on the left side. When the rotating speed of the left-side electric motor 11L is larger than the rotating speed of the right-side electric motor 11R, the conveying speed on the left side of the nozzle-array direction gets larger than that on the right side. Thus, by adjusting the conveying speed in the nozzle-array direction, that is, the direction intersecting the conveying direction, the conveyed posture of the print medium 1 can be controlled.

The first liquid jet heads 2 and second liquid jet heads 3 are deviated from each other in the print medium 1 conveying direction in association with each of four colors of, for example, yellow (Y), magenta (M), cyan (C), and black (K). A liquid such as ink is fed from liquid tanks of the respective colors, which are not shown, to the liquid jet heads 2 and 3 over liquid feed tubes. Each of the liquid jet heads 2 and 3 has multiple nozzles formed in the direction intersecting the print medium 1 conveying direction. A required amount of liquid is jetted concurrently from the nozzles to a required point, whereby a microscopic dot is formed on the print medium 1. Since the formation of a dot is performed for each of the colors, when the print medium 1 conveyed by the first conveying section 4 and second conveying section 5 is passed once, printing through one pass is achieved.

As methods for jetting liquid from the nozzle of each of the liquid jet heads, an electrostatic technique, a piezoelectric technique, and a film boiling liquid jet technique are available. The piezoelectric technique is employed in the first embodiment. The piezoelectric technique is such that: when a drive signal is applied to a piezoelectric element serving as an actuator, a diaphragm in a cavity is displaced to bring about a change in pressure in the cavity; and liquid is jetted out of the nozzles due to the change in pressure. An amount of liquid to be jetted can be adjusted by adjusting the crest value of the drive signal or a gradient in a voltage to be increased or decreased. The actuator formed with the piezoelectric element is a capacitive load having an electrostatic capacitance.

The nozzles of the first liquid jet heads 2 are formed only on the sides thereof above the four first conveying belts 6 of the first conveying section 4, and the nozzles of the second liquid jet heads 3 are formed only on the sides thereof above the four second conveying belts 7 of the second conveying section 5. This is intended to clean the liquid jet heads 2 and 3 using a cleaning unit to be described later. However, if one of the first liquid jet heads and second liquid jet heads is used, whole surface printing cannot be achieved through one pass. Therefore, the first liquid jet heads 2 and second liquid jet heads 3 are deviated from each other in the print medium 1 conveying direction so that the first liquid jet heads and second liquid jet heads can compensate for failure in printing each other.

What is disposed below the first liquid jet heads 2 is a first cleaning cap 12 that cleans the first liquid jet heads 2, and what is disposed below the second liquid jet heads 3 is a second cleaning cap 13 that cleans the second liquid jet heads 3. The cleaning caps 12 and 13 are formed to have a size permitting passage between adjoining ones of the four first conveying belts 6 of the first conveying section 4 or between adjoining ones of the four second conveying belts 7 of the second conveying section 5. The cleaning caps 12 and 13 each include a square-shaped bottomed cap body that covers the nozzles formed in the lower surfaces of the liquid jet heads 2 or 3, that is, the nozzle surfaces thereof, and can come into contact with the nozzle surfaces, a liquid absorber attached to the bottom of the cap body, a tube pump coupled to the bottom of the cap body, and a lifting and lowering device that lifts and lowers the cap body. The cap body is raised by the lifting and lowering device so that the cap body will come into contact with the nozzle surfaces of the liquid jet heads 2 or 3. In this state, when the tube pump is used to generate a negative pressure in the cap body. Liquid or bubbles are sucked out of the nozzles formed in the nozzle surfaces of the liquid jet heads 2 or 3, whereby the liquid jet heads 2 or 3 are cleaned. After the cleaning is completed, the cleaning caps 12 and 13 are lowered.

A pair of gate rollers 14 that adjusts the timing of feeding the print medium 1 fed from a paper feed section 15 and corrects the skew of the print medium 1 is disposed on the upstream side of the first driven rollers 9R and 9L. What is referred to as the skew is a distortion of the print medium 1 with respect to the conveying direction. A pickup roller 16 to be used to feed the print medium 1 is disposed above the paper feed section 15. Reference numeral 17 denotes a gate roller motor that drives the gate rollers 14.

A belt charging device 19 is disposed below the driving rollers 8R and 8L. The belt charging device 19 includes a charging roller 20 that abuts on the first conveying belts 6 and second conveying belts 7 with the first conveying belts 6 and second conveying belts 7 clamped between the charging roller 20 and the driving rollers 8R and 8L, a spring 21 that presses the charging roller 20 to the first conveying belts 6 and second conveying belts 7, and a power supply 18 that applies charge to the charging roller 20. The belt charging device 19 applies charge to the first conveying belts 6 and second conveying belts 7 through the charging roller 20 so as to charge the first conveying belts and second conveying belts. In general, the belts are formed with intermediately or highly resistive bodies or insulators. Therefore, when the belts are charged by the belt charging device 19, charge applied to the surfaces thereof induces dielectric polarization in the print medium 1 formed with a highly resistive body or an insulator. Owing to electrostatic force generated between charge, which derives from the dielectric polarization, and the charge on the surfaces of the belts, the print medium 1 can be adsorbed to the belts. Incidentally, as a charging means, a corotron technique of causing charge to fall may be adopted.

According to the liquid jet type printing apparatus to which the liquid jet apparatus of the first embodiment is adapted, the belt charging device 19 charges the surfaces of the first conveying belts 6 and second conveying belts 7. In this state, the print medium 1 is fed through the gate rollers 14, and pressed against the first conveying belts 6 using a paper press roller that is not shown. Owing to the foregoing operation of dielectric polarization, the print medium 1 is adsorbed to the surfaces of the first conveying belts 6. In this state, the driving rollers 8R and 8L are driven to rotate by the electric motors 11R and 11L. The rotational driving force is transmitted to the first driven rollers 9R and 9L over the first conveying belts 6.

With the print medium 1 adsorbed, the first conveying belts 6 are moved to the downstream side of the conveying direction in order to move the print medium 1 to below the first liquid jet heads 2. Liquid is jetted through the nozzles formed in the first liquid jet heads 2 in order to achieve printing. After printing by the first liquid jet heads 2 is completed, the print medium 1 is moved to the downstream side of the conveying direction, and caused to ride the second conveying belts 7 of the second conveying section 5. As mentioned above, since the second conveying belts 7 have the surfaces thereof charged by the belt charging device 19, the print medium 1 is adsorbed to the surfaces of the second conveying belts 7 due to the operation of dielectric polarization.

In this state, the second conveying belts 7 are moved to the downstream side of the conveying direction in order to move the print medium 1 to below the second liquid jet heads 3. Liquid is jetted through the nozzles formed in the second liquid jet heads 3 in order to achieve printing. After the printing by the second liquid jet heads 3 is completed, the print medium 1 is further moved to the downstream side of the conveying direction. While the print medium 1 is separated from the surfaces of the second conveying belts 7 using a separating device that is not shown, the print medium is discharged to a paper discharge section.

When cleaning of the first and second liquid jet heads 2 and 3 is needed, the first and second cleaning caps 12 and 13 are raised as mentioned above so that the cap bodies will come into contact with the nozzle surfaces of the first and second liquid jet heads 2 and 3. In this state, a negative pressure is generated in the cap bodies in order to suck liquid or bubbles through the nozzles of the first and second liquid jet heads 2 and 3 for the purpose of cleaning. Thereafter, the first and second cleaning caps 12 and 13 are lowered.

Figure 2:
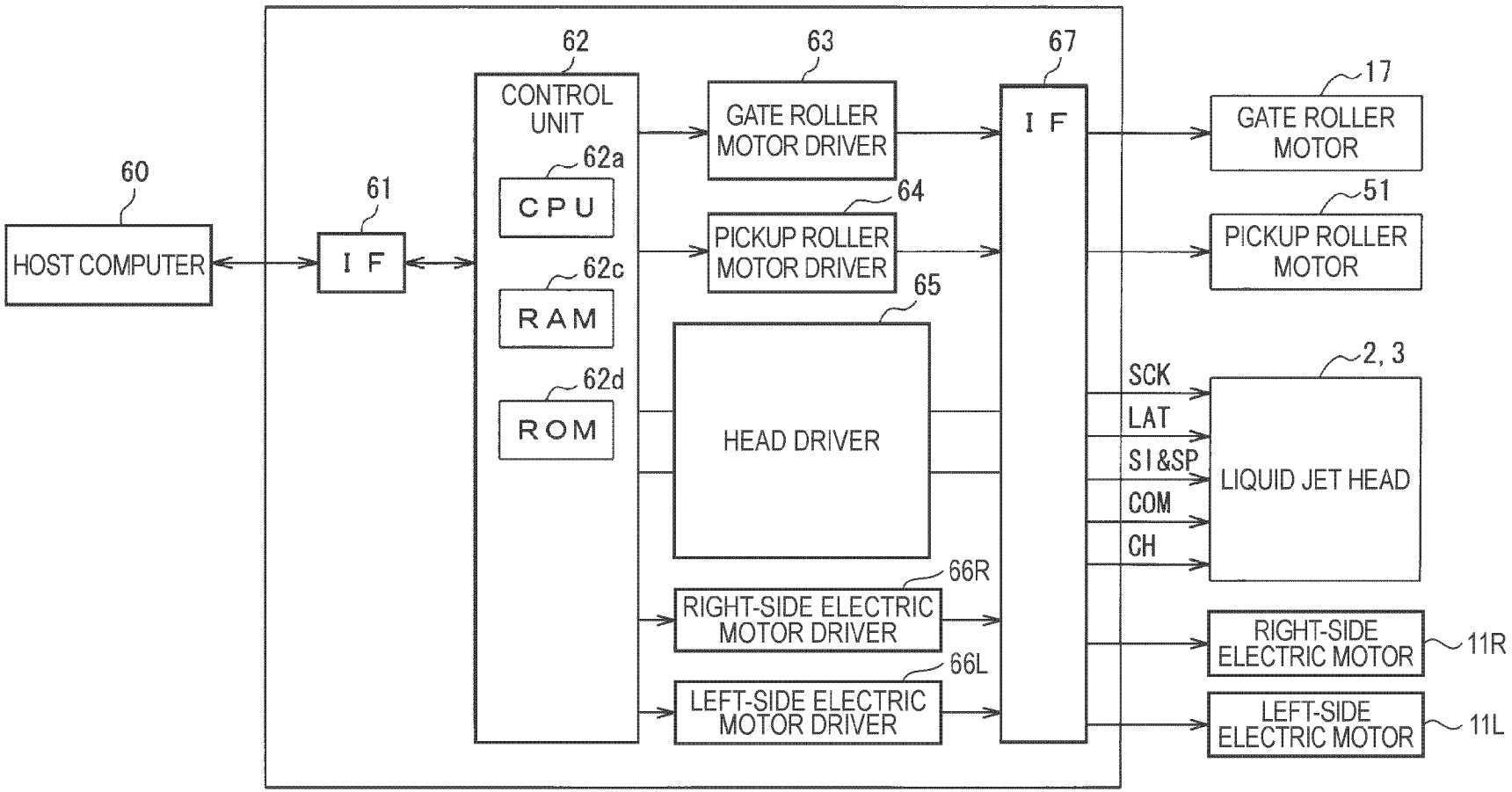
FIG. 2 is a block diagram of a control device of the liquid jet type printing apparatus.

In the liquid jet type printing apparatus to which the liquid jet apparatus of the first embodiment is adapted, a control device is included for controlling the liquid jet type printing apparatus. The control device includes: as shown in FIG. 2, an input interface 61 that receives print data inputted from a host computer 60; a control section 62 formed with a microcomputer that executes printing processing on the basis of print data inputted through the input interface 61; a gate roller motor driver 63 that drives or controls the gate roller motor 17; a pickup roller motor driver 64 that drives or controls a pickup roller motor 51; a head driver 65 that drives or controls the liquid jet heads 2 and 3; a right-side electric motor driver 66R that drives or controls the right-side electric motor 11R; a left-side electric motor driver 66L that drives or controls the left-side electric motor 11L; and an interface 67 via which the gate roller motor driver 63, pickup roller motor driver 64, head driver 65, right-side electric motor driver 66R, and left-side electric motor driver 66L are connected to the gate roller motor 17, pickup roller motor 51, liquid jet heads 2 and 3, right-side electric motor 11R, and left-side electric motor 11L respectively.

The control section 62 includes: a central processing unit (CPU) 62*a* that executes various pieces of processing including printing processing; a random access memory (RAM) 62*c* in which print data inputted via the input interface 61 or various data items to be used to execute print data printing processing are temporarily stored, or a program such as a printing processing program is tentatively developed; and a read-only memory (ROM) 62*d* formed with a nonvolatile semiconductor memory in which control programs to be run by the CPU 62*a* are stored. When the control section 62 acquires print data (image data) from the host computer 60 via the interface 61, the CPU 62*a* executes predetermined processing for the print data so as to calculate nozzle selection data which signifies through which of the nozzles liquid should be jetted or to what degree liquid should be jetted, or drive signal output data relevant to the actuators. Based on the print data, drive signal output data, and data items inputted from various sensors, drive signals and control signals are outputted to the gate roller motor driver 63, pickup roller motor driver 64, head driver 65, right-side electric motor driver 66R, and left-side electric motor driver 66L respectively. The drive signals and control signals cause the actuators 22 associated with the multiple nozzles of the liquid jet heads 2 and 3, the gate roller motor 17, the pickup roller motor 51, the right-side electric motor 11R, and the left-side electric motor 11L to start. Feed and conveyance of the print medium 1, control of the posture of the print medium 1, and printing processing relevant to the print medium 1 are executed. Incidentally, the components of the control section 62 are electrically interconnected over a bus that is not shown.

Figure 3:
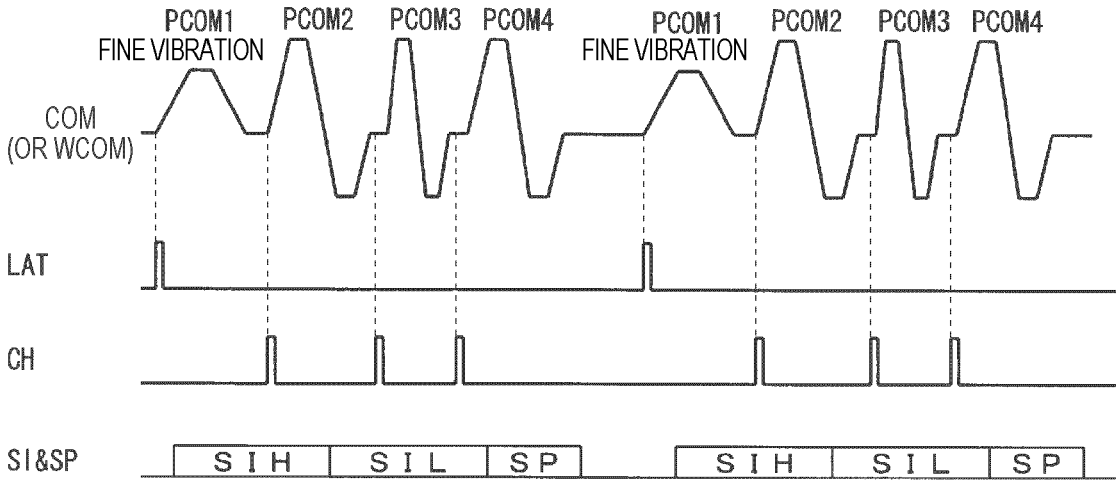
FIG. 3 is an explanatory diagram of a drive signal to be used to drive actuators.

FIG. 3 shows an example of a drive signal COM that is fed from the control device of the liquid jet type printing apparatus, to which the liquid jet apparatus of the first embodiment is adapted, to the liquid jet heads 2 and 3 and that is used to drive the actuators 22 formed with piezoelectric elements. In the first embodiment, the drive signal is a signal whose electric potential varies with an intermediate electric potential as a center. The drive signal COM has drive pulses PCOM, each of which serves as a unit drive signal with which each of the actuators 22 is driven to jet liquid, time-sequentially concatenated. The leading edge of each of the drive pulses PCOM indicates a step of expanding the volume of the cavity (pressure chamber), which communicates with the nozzles, so as to introduce liquid (may be said to be a step of introducing meniscus when consideration is taken into the jetting surface of liquid). The trailing edge of the drive pulse PCOM indicates a step of reducing the volume of the cavity so as to thrust liquid (may be said to be a step of thrusting meniscus when consideration is taken into the jetting surface of liquid). As a result of thrust of liquid, the liquid is jetted out of the nozzles.

When the gradient in an increasing or decreasing voltage of the drive pulse PCOM that is a voltage of a trapezoidal wave, or the crest value thereof is changed to various values, an amount of liquid to be introduced and an introducing speed, or an amount of liquid to be thrust and a thrusting speed can be varied. Accordingly, an amount of liquid to be jetted can be varied in order to produce a dot having a different size. Even when the multiple drive pulses PCOM are time-sequentially concatenated, a sole drive pulse PCOM may be selected from among all the drive pulses and fed to the actuator 22 in order to jet liquid. Otherwise, multiple drive pulses PCOM may be selected therefrom and fed to the actuator 22 in order to jet liquid multiple times. This makes it possible to produce dots of various sizes. Namely, before liquid is dried up, if multiple liquid droplets are shot to the same position, it substantially exerts the same effect as the effect of jetting a large amount of liquid. The size of a dot can be increased. The combination of the foregoing techniques permits realization of multiple gray-scale levels. The drive pulse PCOM1 on the leftmost side of FIG. 3 causes liquid to be introduced but does not cause the liquid to be thrust out. The drive pulse PCOM1 is called a minute fluctuation and used to suppress or prevent an increase in viscosity of the nozzles without causing liquid to be jetted out.

As a result, the drive signal COM outputted from a drive signal output circuit to be described later, and drive pulse selection data SI&SP that is used to select nozzles, through which liquid is jetted, according to print data and to determine the timing of applying the drive signal COM to the actuators 22 such as piezoelectric elements are inputted to the liquid jet heads 2 and 3. Further, a clock signal SCK that after the nozzle selection data is inputted to all the nozzles, is used to transmit as a serial signal a latch signal LAT, which allows the drive signal COM to be applied to the actuators 22 of the liquid jet heads 2 and 3 according to the drive pulse selection data SI&SP, a channel signal CH, and the drive pulse selection data SI&SP to the liquid jet heads 2 and 3 is inputted to the liquid jet heads 2 and 3. Hereinafter, the minimum unit of the drive signal to be used to drive each of the actuators 22 shall be referred to as the drive pulse PCOM, and an entire signal having the drive pulses PCOM time-sequentially concatenated shall be referred to as the drive signal COM.

Figure 4:
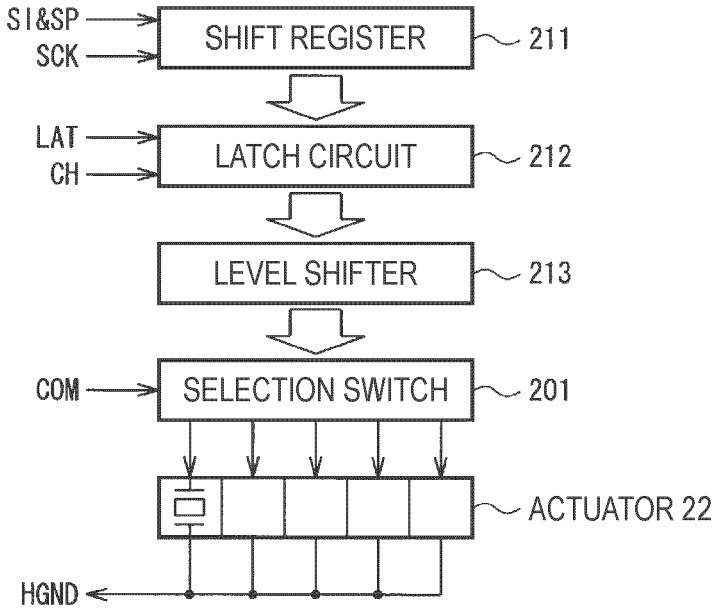
FIG. 4 is a block diagram of a selection unit that applies a drive signal to the actuators.

Next, a construction for applying the drive signal COM, which is outputted from the drive circuit, to the actuators 22 such as piezoelectric elements will be described below. FIG. 4 is a block diagram of a selection unit that applies the drive signal COM to the actuators 22 such as piezoelectric elements. The selection unit includes: a shift register 211 that preserves the drive pulse selection data SI&SP to be used to designate the actuators 22 such as piezoelectric elements associated with nozzles through which liquid is jetted; a latch circuit 212 that tentatively preserves data in the shift register 211; a level shifter 213 that converts the level of an output of the latch circuit 212 to another; and selection switches 201 via which the drive signal COM is applied to the actuators 22 such as piezoelectric elements according to the output of the level shifter.

The drive pulse selection data SI&SP is inputted one after another to the shift register 211. Synchronously with an input pulse of the clock signal SCK, the storage area of the shift register 211 is sequentially shifted from the initial stage to the subsequent stages. After the same number of drive pulse selection data items SI&SP as the number of nozzles are stored in the shift register 211, the latch circuit 212 latches the output signals of the shift register 211 according to the inputted latch signal LAT. The signals stored in the latch circuit 212 are converted into signals, voltage levels of which are high enough to turn on or off the selection switches 201 in the next stage, by the level shifter 213. This is because: the drive signal COM is a voltage higher than the output voltage of the latch circuit 212; and the operating voltage range for the selection switches 201 is set to a range of high voltages accordingly. The actuators 22 such as piezoelectric elements associated with the selection switches 201 that are turned off by the level shifter 213 are applied the drive signal COM (drive pulses PCOM) at the timings of applying the drive pulse selection data SI & SP. After the drive pulse selection data items SI&SP in the shift register 211 are stored in the latch circuit 212, the next printing information is inputted to the shift register 211, and the data items stored in the latch circuit 212 are sequentially updated at the timings of jetting liquid. Reference symbol HGND denotes a ground to which the actuators 22 such as piezoelectric elements are connected. According to the selection switches 201, after the application of the drive signal COM (drive pulses PCOM) to the actuators 22 such as piezoelectric elements is ceased, the input voltages of the actuators 22 are held at the voltages attained immediately before the application is ceased.

Figure 5:
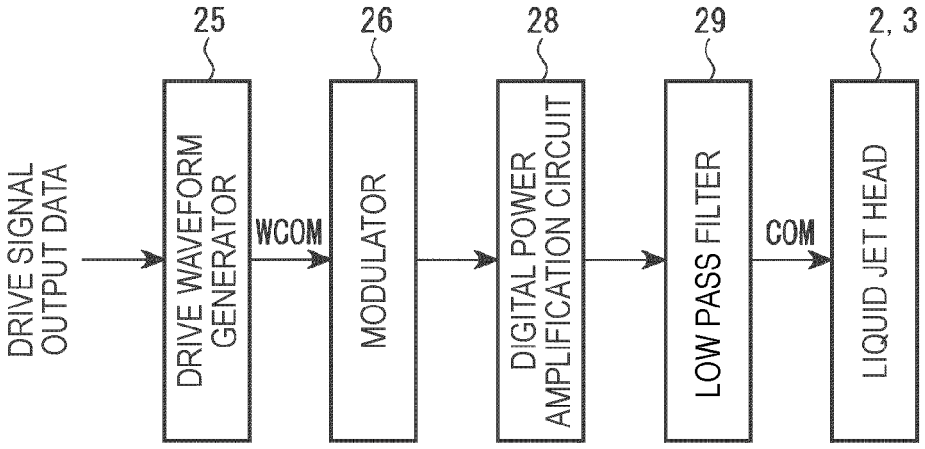
FIG. 5 is a block diagram showing the first embodiment of a drive signal output circuit constructed in a head driver shown in FIG. 2.
Figure 6:
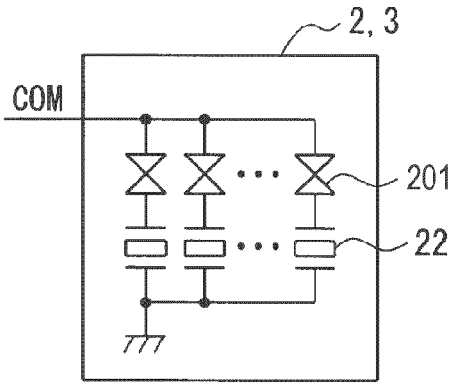
FIG. 6 is a block diagram of a liquid jet head mentioned in FIG. 5.

FIG. 5 shows an example of a concrete construction of the drive signal output circuit in the head driver 65 that drives the actuators 22. Numerous nozzles are formed in the liquid jet heads 2 and 3 included in the liquid jet type printing apparatus. As shown in FIG. 6, the foregoing actuators 22 are included in the respective liquid jet heads 2 and 3. The selection switches 201 formed with transmission gates are disposed on the upstream sides of the respective actuators 22. The selection switches 201 are turned on or off according to print data by means of a nozzle selection control circuit that is not shown. The drive signal COM (drive pulses PCOM) is applied to the actuators 22 alone associated with the selection switches 201 that are turned on.

The drive signal output circuit includes: a drive waveform generator 25 that produces a drive waveform signal WCOM serving as a base of a drive signal COM (drive pulses PCOM) that is, a reference for a signal to be used to control drive of the actuators 22; a modulator 26 that pulse-modulates the drive waveform signal WCOM produced by the drive waveform generator 25; a digital power amplification circuit 28 that amplifies the power of a modulated signal resulting from pulse modulation performed by the modulator 26; and a low pass filter 29 that smoothes the amplified digital signal resulting from power amplification performed by the digital power amplification circuit 28, and feeds the resultant signal as a drive signal COM (drive pulses PCOM) to the actuators 22 of the liquid jet heads 2 and 3.

Figure 7:
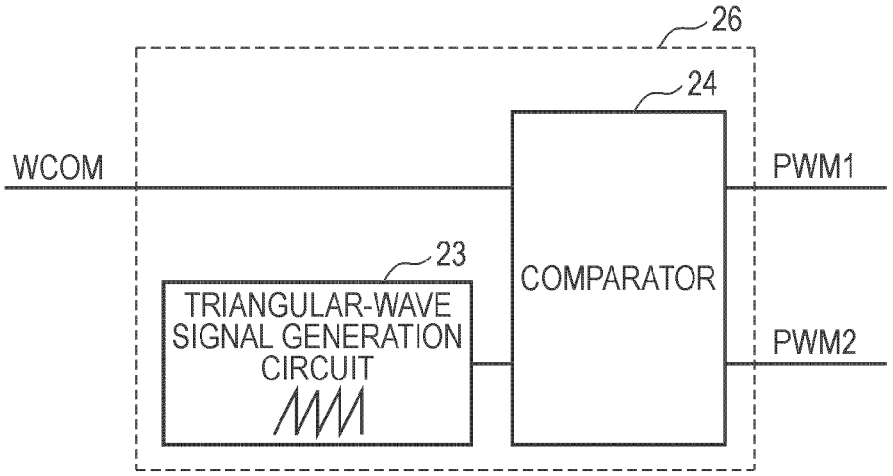
FIG. 7 is a block diagram of a modulator mentioned in FIG. 5.

The drive waveform generator 25 time-sequentially combines pre-set digital electric potential data items and outputs the result as a drive waveform signal WCOM. In the first embodiment, a general pulse-width modulation (PWM) circuit is adopted as the modulator 26 that pulse-modulates the drive waveform signal WCOM. The pulse-width modulation is, as shown in FIG. 7, achieved in such a manner that: a triangular-wave signal generation circuit 23 generates a triangular-wave signal of a predetermined frequency; a comparator 24 compares the triangular-wave signal with the drive waveform signal WCOM; and a pulse signal that enters the on-duty thereof when the drive waveform signal WCOM has a larger than the triangular-wave signal does is outputted as a modulated signal. However, the triangular-wave signal in the first embodiment has a electric potential value that is about a half of the crest value of the drive waveform signal WCOM. Comparative pulses between the triangular-wave signal and drive waveform signal WCOM are outputted as a first modulated signal PWM1. Comparative pulses between a signal, which is produced by applying as a bias voltage a electric potential value of which is equivalent to the crest value of the triangular-wave signal to the triangular-wave signal, and the drive waveform signal WCOM are outputted as a second modulated signal PWM2. In the first embodiment, since two stages of digital power amplifiers are included in the digital power amplification circuit 28, the modulator 26 outputs the same number of modulated signals as the number of digital power amplifiers.

Figure 8:
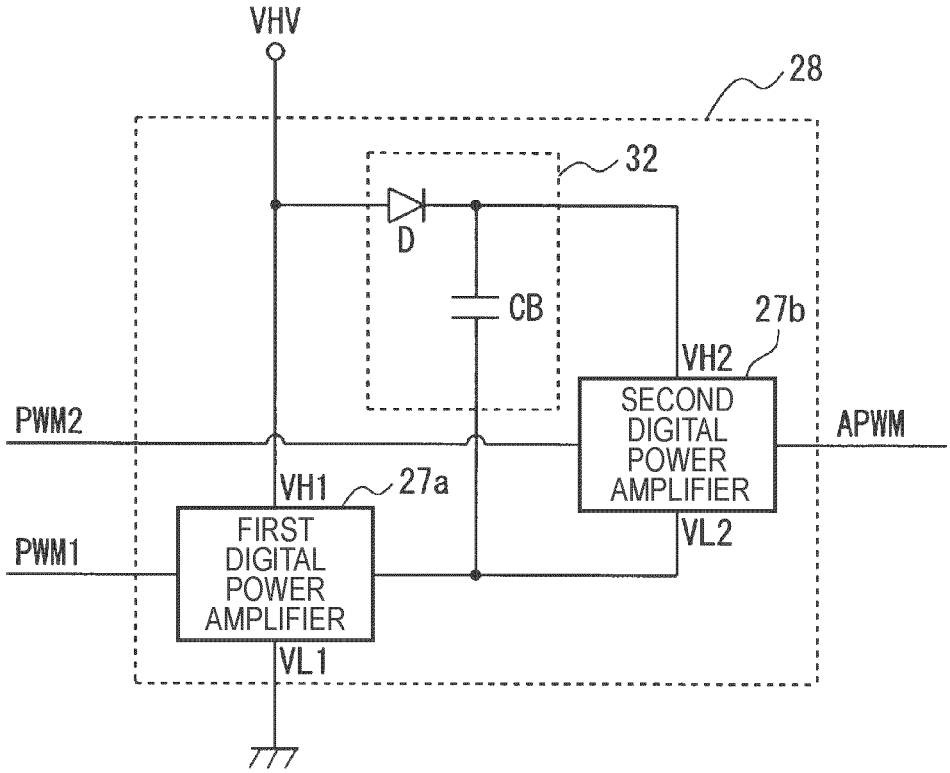
FIG. 8 is a block diagram of a digital power amplification circuit mentioned in FIG. 5.

The digital power amplification circuit 28 shown in FIG. 8 includes, as mentioned above, a first digital power amplifier 27*a* that amplifies the power of the first modulated signal PWM1 and a second digital power amplifier 27*b* that amplifies the power of the second modulated signal PWM2. The high-potential side of the first digital power amplifier 27*a* is connected to a power supply VHV, and the low-potential side thereof is grounded. A bootstrap circuit 32 is interposed between the second digital power amplifier 27*b* and first digital power amplifier 27*a*. The high-potential side of the second digital power amplifier 27*b* is connected to the power supply VHV via a rectifier D included in the bootstrap circuit 32, and the low-potential side thereof is connected to the output terminal of the first digital power amplifier 27*a*. Namely, the electric potential at the low-potential side of the second digital power amplifier 27*b* in a succeeding stage is biased with the output of the first digital power amplifier 27*a* in a preceding stage. The bootstrap circuit 32 includes the rectifier D that restricts a current coming from the high-potential side of the second digital power amplifier 27*b*, and a capacitor CB to be charged with a electric potential difference between the power supply VHV and the output terminal of the first digital power amplifier 27*a*. The capacitance of the capacitor CB, as mentioned above, is large enough to drive the actuators 22 that are formed with piezoelectric elements and serve as a capacitive load. Specifically, the capacitance is large enough to ensure a voltage required for bootstrapping in a case where the first digital power amplifier 27*a* in the preceding state is energized and the second digital power amplifier 27*b* in the succeeding stage is energized or de-energized.

Figure 9:
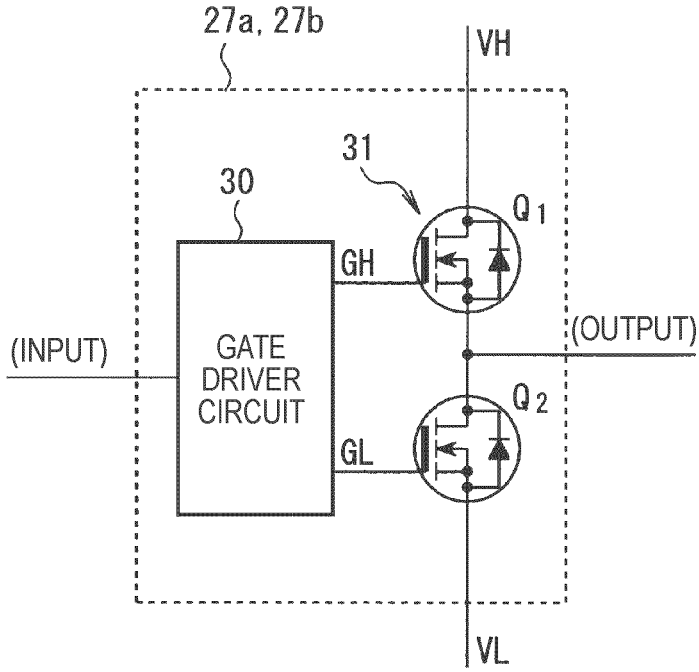
FIG. 9 is a block diagram of a digital power amplifier shown in FIG. 8.

Each of the first digital power amplifier 27*a* and second digital power amplifier 27*b* includes, as shown in FIG. 9, a half-bridge output stage 31 composed of a switching element Q1 on a high-potential side to be used to substantially amplify a power and a switching element Q2 on a low-potential side, and a gate driver circuit 30 that regulates gate-source signals GH and GL of the switching elements Q1 and Q2 respectively according to a modulated signal sent from the modulator 26. The gate-source signals GH and GL of the two switching elements Q1 and Q2 respectively are reverse signals. In each of the first digital power amplifier 27*a* and second digital power amplifier 27*b*, when the modulated signal exhibits a high level, the gate-source signal GH of the high-potential side switching element Q1 takes on the high level and the gate-source signal GL of the low-potential side switching element Q2 takes on a low level. The high-potential side switching element Q1 is therefore turned on, and the low-potential side switching element Q2 is turned off. As a result, the output of the half-bridge output stage 31 becomes a high electric potential. When the modulated signal exhibits the low level, the gate-source signal GH of the high-potential side switching element Q1 takes on the low level, and the gate-source signal GL of the low-potential side switching element Q2 takes on the high level. Therefore, the high-potential side switching element Q1 is turned off, and the low-potential side switching element Q2 is turned on. As a result, the output of the half-bridge output stage 31 becomes a low electric potential.

As mentioned above, when the high-potential side switching element Q1 and low-potential side switching element Q2 are digitally driven, a current flows through the switching element that remains on. However, the drain-source resistance is so small that a loss is hardly generated. Since no current flows through the switching element that remains off, no loss is generated. Therefore, a loss caused by the digital power amplifiers 27*a* and 27*b* is so small that switching elements formed with compact MOSFETs can be adopted and a cooling means such as a cooling heat sink is unnecessary. Incidentally, the efficiency in linearly driving a transistor is on the order of 30%, while the efficiency of the first digital power amplifier 27*a* and second digital power amplifier 27*b* is equal to or larger than 90%. As for the cooling heat sink in the transistor, a size of about 60 mm in length and width is needed for one transistor. When the cooling heat sink is unnecessary, it is drastically advantageous in terms of an actual layout.

Figure 10:
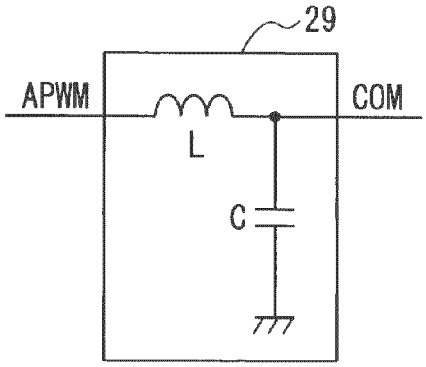
FIG. 10 is a block diagram of a low pass filter mentioned in FIG. 5.

The low pass filter 29 is composed of, as shown in FIG. 10, a coil L and a capacitor C. The low-pass filter removes the modulation frequency component of the amplified digital signal APWM, or in this case, the frequency component equivalent to the triangular-wave signal.

In the first embodiment, the second digital power amplifier 27*b* is disposed in the stage succeeding the first digital power amplifier 27*a* in the preceding stage that has the high-potential side thereof connected to the power supply VHV. The low-potential side of the second digital power amplifier 27*b* is bootstrapped to the electric potential equivalent to that at the power supply VHV by the bootstrap circuit 32. When the second digital power amplifier 27*b* is de-energized, the output of the first digital power amplifier 27*a* is outputted as the amplified digital signal APWM from the second digital power amplifier 27*b* as it is. When the second digital power amplifier 27*b* is energized, the sum of the output of the first digital power amplifier 27*a* and the output of the second digital power amplifier 27*b* is outputted as the amplified digital signal APWM from the second digital power amplifier 27*b*.

Figure 11:
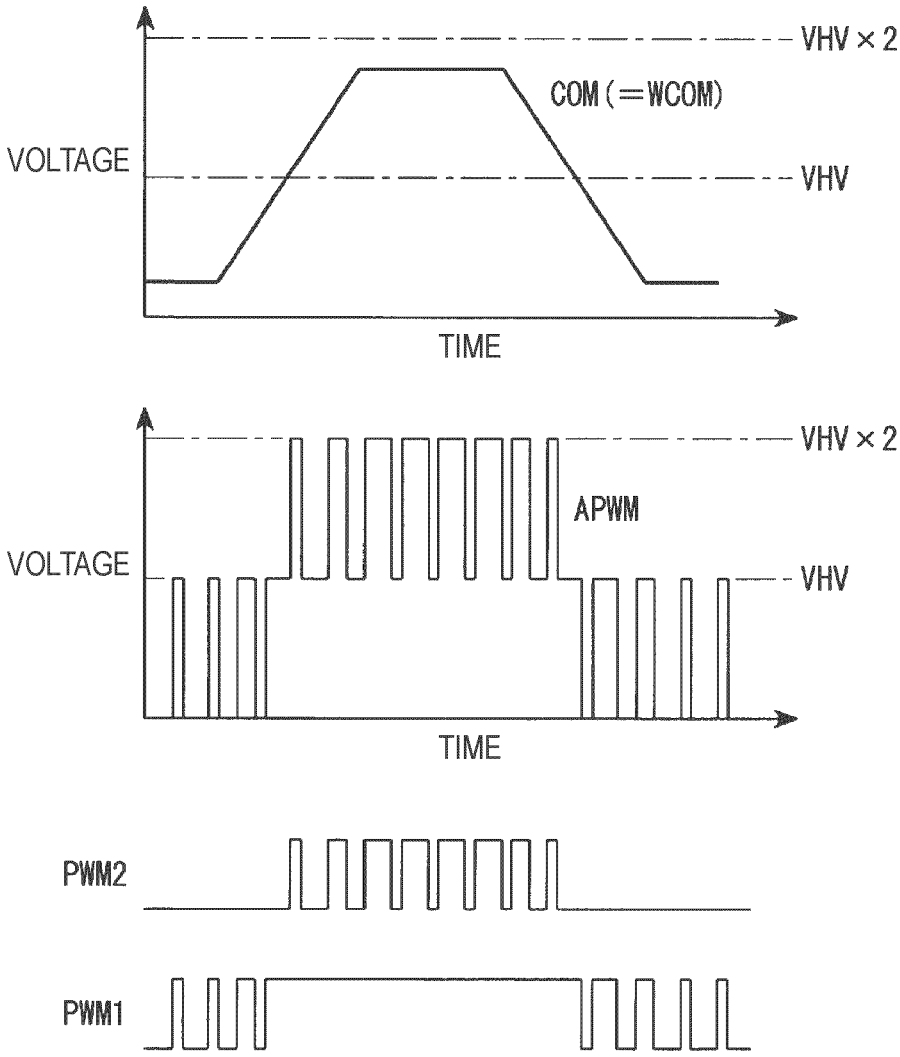
FIG. 11 is an explanatory diagram of an amplified digital signal and a drive signal employed in the first embodiment.

FIG. 11 shows time-sequential changes in the first modulated signal PWM1, second modulated signal PWM2, amplified digital signal APWM, and drive signal COM employed in the first embodiment. In the first embodiment, the crest value of a triangular-wave signal is set to about a half of the crest value of the drive waveform signal WCOM. Comparative pulses between the triangular-wave signal and drive waveform signal WCOM are outputted as the first modulated signal PWM1. Comparative pulses between a signal, which is produced by applying as a bias voltage a electric potential value of which is equivalent to the crest value of the triangular-wave signal, to the triangular-wave signal, and the drive waveform signal WCOM are outputted as the second modulated signal PWM2. Assuming that the drive signal COM shown in FIG. 11 and the drive waveform signal WCOM are identical to each other, the triangular-wave signal varies from a zero electric potential to the electric potential at the power supply VHV. The signal produced by applying as a bias voltage electric potential value of which is equivalent to the crest value of the triangular-wave signal, to the triangular-wave signal varies between the electric potential at the power supply VHV and a double of the electric potential. In a domain in which the drive waveform signal WCOM (drive signal COM in FIG. 11) becomes a electric potential equal to or larger than the electric potential at the power supply VHV, the first modulated signal PWM1 remains at the high level.

The amplified digital signal APWM has a electric potential value equivalent to the sum of the electric potential value of the first modulated signal PWM1 and the electric potential value of the second modulated signal PWM2. The amplified digital signal APWM outputted from the first power amplifier 27*a* by amplifying the power of the first modulated signal PWM1 is composed of pulses varying between the electric potential at the power supply VHV and the zero electric potential. The amplified digital signal APWM that is added to the amplified digital signal APWM and that is outputted from the second digital power amplifier 27*b* by amplifying the power of the second modulated signal PWM2 is composed of pulses varying between the electric potential at the power supply VHV and the double of the electric potential. Therefore, the amplified digital signal APWM that is the sum of the two amplified digital signals reaches the zero electric potential, the electric potential at the power supply VHV, and the double of the electric potential at the power supply VHV. Therefore, the number of steps of electric potentials the amplified digital signal reaches is three and larger than the number of stages of the digital power amplifiers 27*a* and 27*b*, that is, 2. The larger the number of steps of electric potentials the amplified digital signal APWM that has not been smoothed by the low pass filter 29 reaches is, the higher the precision in the waveform of the smoothed drive signal COM is.

Figure 12:
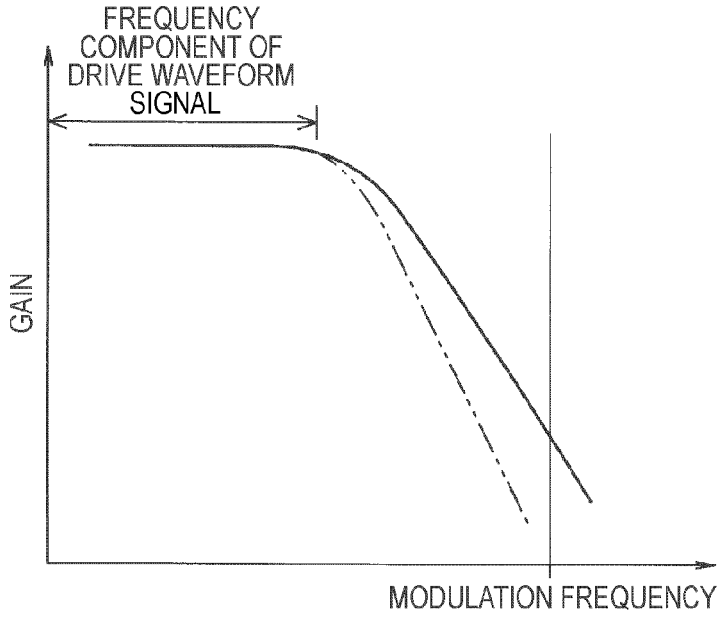
FIG. 12 is an explanatory diagram of the frequency characteristic of the low pass filter.

Since the voltage at the power supply VHV may be about a half of the crest value of the drive signal COM, that is, the amplified digital signal APWM, the frequency characteristic of the low pass filter 29 may not be a sharp one expressed by an alternate long and two short dashes line in FIG. 12. Even when the frequency characteristic of the low pass filter 29 is a relatively moderate frequency characteristic expressed by a solid line in FIG. 12, the modulation frequency can be fully removed. In other words, the order of the low pass filter 29 can be decreased and the circuitry can be simplified and downsized. In addition, since the electric potential difference between the terminals of the coil L decreases, a loss derived from hysteresis gets smaller. Even when a total current flowing through the digital power amplifiers 27*a* and 27*b* in two stages remains unchanged, since the voltage at the power supply VHV may be about a half of the crest value of the drive signal COM, that is, the amplified digital signal APWM, power saving can be achieved. Further, the dielectric strength of the switching elements Q1 and Q2 of each of the digital power amplifiers 27*a* and 27*b* can be decreased, and the circuitry can be downsized. When the first digital power amplifier 27*a* in the preceding stage is energized and the second digital power amplifier 27 in the succeeding stage is de-energized, regeneration in which charge in the actuators 22 that serve as a capacitive load and charge in the capacitor CB in the bootstrap circuit 32 flow into the power supply VHV takes place. Further power saving can be achieved.

Figure 13:
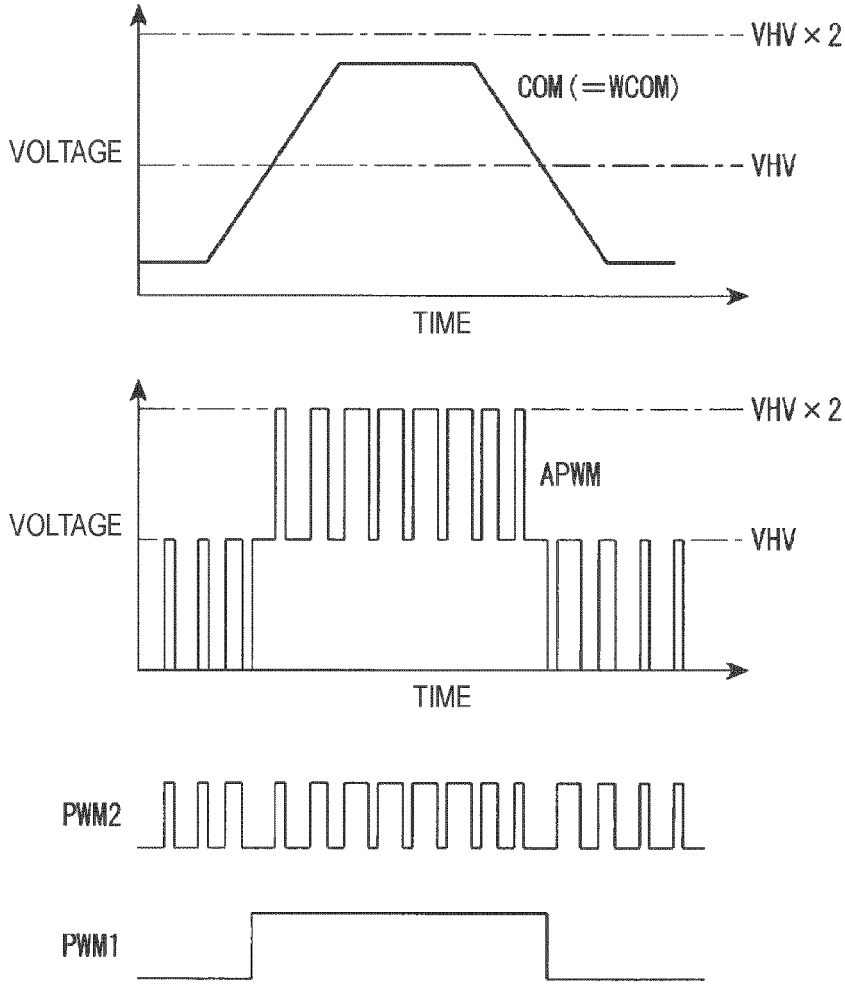
FIG. 13 is an explanatory diagram of different examples of the amplified digital signal and drive signal employed in the second embodiment.

FIG. 13 shows different examples of the first modulated signal PWM1 and second modulated signal PWM2 employed in the first embodiment. Even in this case, the amplified digital signal APWM identical to the one shown in FIG. 11 can be produced by the digital power amplification circuit 28 shown in FIG. 8, and the identical drive signal COM can be produced accordingly. In this example of driving, for example, assuming that the drive signal COM shown in FIG. 13 is identical to the drive waveform signal WCOM, pulses that enter the on-duty thereof when the drive waveform signal WCOM has a electric potential value larger than the electric potential at the power supply VHV are outputted as the first modulated signal PWM1. When the first modulated signal PWM1 is in the off-duty thereof, comparative pulses between the triangular-wave signal and drive waveform signal WCOM are outputted as the second modulated signal PWM2. When the first modulated signal PWM1 is in the on-duty thereof, comparative pulses between a signal, which is produced by adding the voltage at the power supply VHV to the triangular-wave signal, and the drive waveform signal WCOM are outputted as the second modulated signal PWM2.

As mentioned above, according to the liquid jet apparatus of the first embodiment, the drive waveform signal WCOM serving as a reference for driving the actuators 22 for liquid jetting is generated by the drive waveform generator 25. The drive waveform signal WCOM is pulse-modulated by the modulator 26. The modulated signal has the power thereof amplified by the digital power amplification circuit 28. The power-amplified digital signal APWM is smoothed by the low pass filter 29, and outputted to the actuators 22. The digital power amplification circuit 28 includes two stages of digital power amplifiers 27*a* and 27*b* each including a pair of push-pull connected switching elements Q1 and Q2. The amplified digital signal APWM is a multi-value signal that reaches a larger number of steps of electric potentials than the number of digital power amplifiers 27*a* and 27*b*. Since the outputs of the digital power amplifiers 27*a* and 27*b* in two stages are combined in order to produce the amplified digital signal APWM, the electric potential difference between adjoining ones of the steps of electric potentials which the amplified digital signal APWM reaches is small. The order of the low pass filter 29 that removes a frequency component equivalent to a modulating signal from the amplified digital signal APWM can be decreased. Since the amplified digital signal APWM is the multi-value signal, the high-precision drive signal COM can be produced. Since the order of the low pass filter 29 can be decreased, the circuitry can be simplified and downsized. Since the electric potential difference between adjoining ones of the steps of electric potentials the amplified digital signal APWM reaches is small, the dielectric strength of the switching elements Q1 and Q2 in each of the digital power amplifiers 27*a* and 27*b* can be decreased. The circuitry can therefore be downsized.

In the digital power amplification circuit 28, the bootstrap circuit 32 is connected to the digital power amplifier 27*b* in the second stage, and the digital power amplifier 27*a* in the preceding stage applies a bias voltage. Even when a consumed current remains unchanged, the voltage at the power supply VHV can be decreased. Downsizing of the circuitry and power saving can be achieved. Especially when the digital power amplifier 27*a* in the preceding stage is energized and the digital power amplifier 27*b* in the succeeding stage is de-energized, power is regenerated. Further power saving can be achieved.

The capacitor CB in the bootstrap circuit 32 has a capacitance that is large enough to drive the actuators 22. For example, when the digital power amplifier 27*a* in the preceding stage is energized, if the digital power amplifier 27*b* in the succeeding stage is energized or de-energized, a voltage required for bootstrap can be ensured.

When the digital power amplifiers 27*a* and 27*b* in the multiple stages are connected to the same power supply, downsizing of circuitry can be achieved.

Since the modulated signals PWM1 and PWM2 are outputted to the digital power amplifiers 27*a* and 27*b* in the multiple stages, the amplified digital signal APWM can be reliably produced as a multi-value signal.

When the modulator 26 is realized with a pulse-width modulation circuit, the frequency characteristic of the low pass filter 29 can be moderated. The drive signal COM can be therefore stabilized.

When the modulator 26 is realized with a pulse-density modulation circuit, for example, a MASH type Δ-Σ modulation circuit, a drive signal of higher precision can be produced. The pulse-density modulation circuit can be realized in a form described in, for example, JP-A-61-177818.

Figure 14:
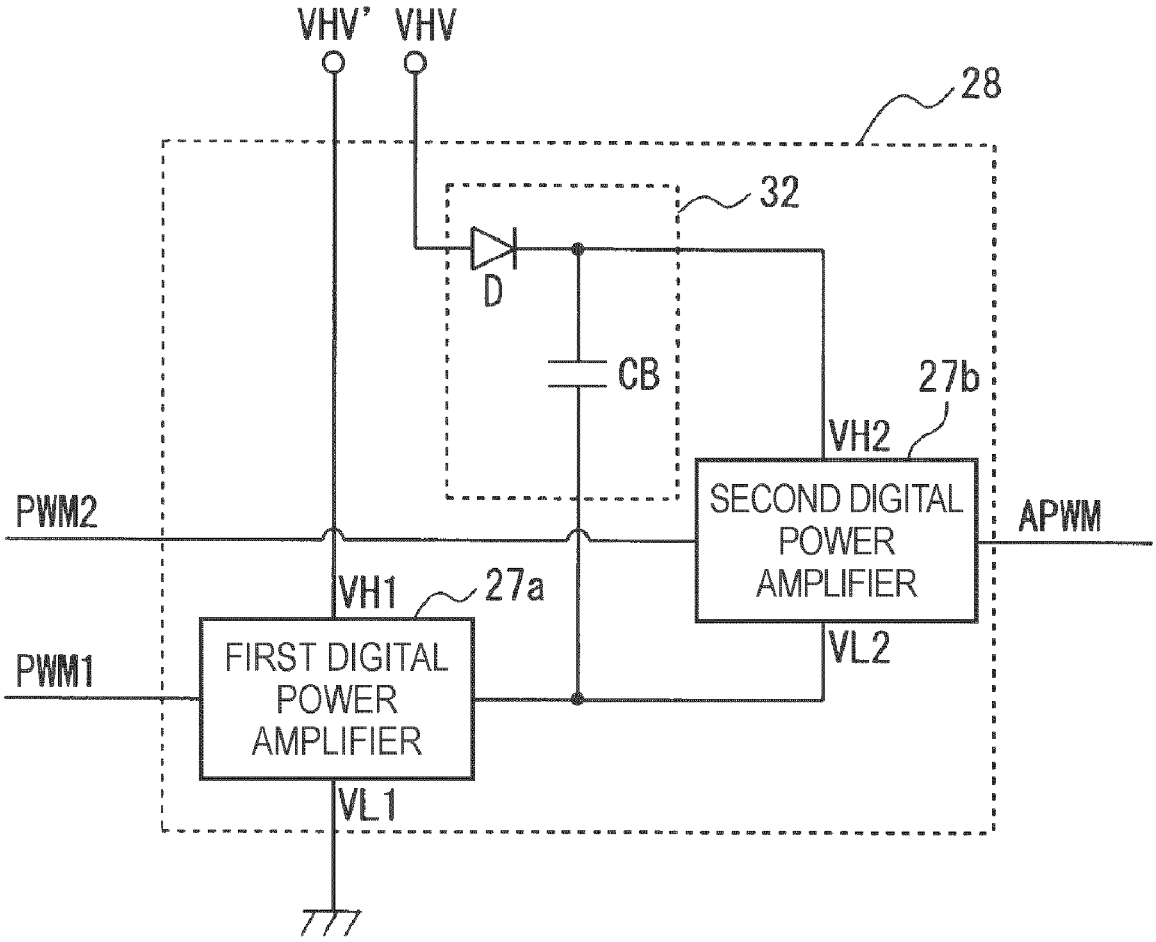
FIG. 14 is a block diagram showing the second embodiment of the digital power amplification circuit included in the liquid jet apparatus of the invention.

Next, the second embodiment in which the liquid jet apparatus of the invention is adapted to the liquid jet type printing apparatus will be described below. FIG. 14 is a block diagram of a digital power amplification circuit 28 employed in a drive signal output circuit included in the second embodiment. The digital power amplification circuit 28 in the second embodiment is analogous to the digital power amplification circuit 28 in the first embodiment shown in FIG. 8, and has many components identical to those of the digital power amplification circuit 28 in the first embodiment. The same reference numerals will be assigned to the identical components, and an iterative description will be omitted. Specifically, the components of the circuit in the second embodiment are all identical to those of the circuit in the first embodiment. The high-potential side of the second digital power amplifier 27*b* is, similarly to that in the first embodiment, connected to the power supply VHV. A difference from the first embodiment lies in a point that the high-potential side of the first digital power amplifier 27*a* is connected to a different second power supply VHV'. In the second embodiment, the voltage at the second power supply VHV' is higher than the voltage at the power supply VHV.

Figure 15:
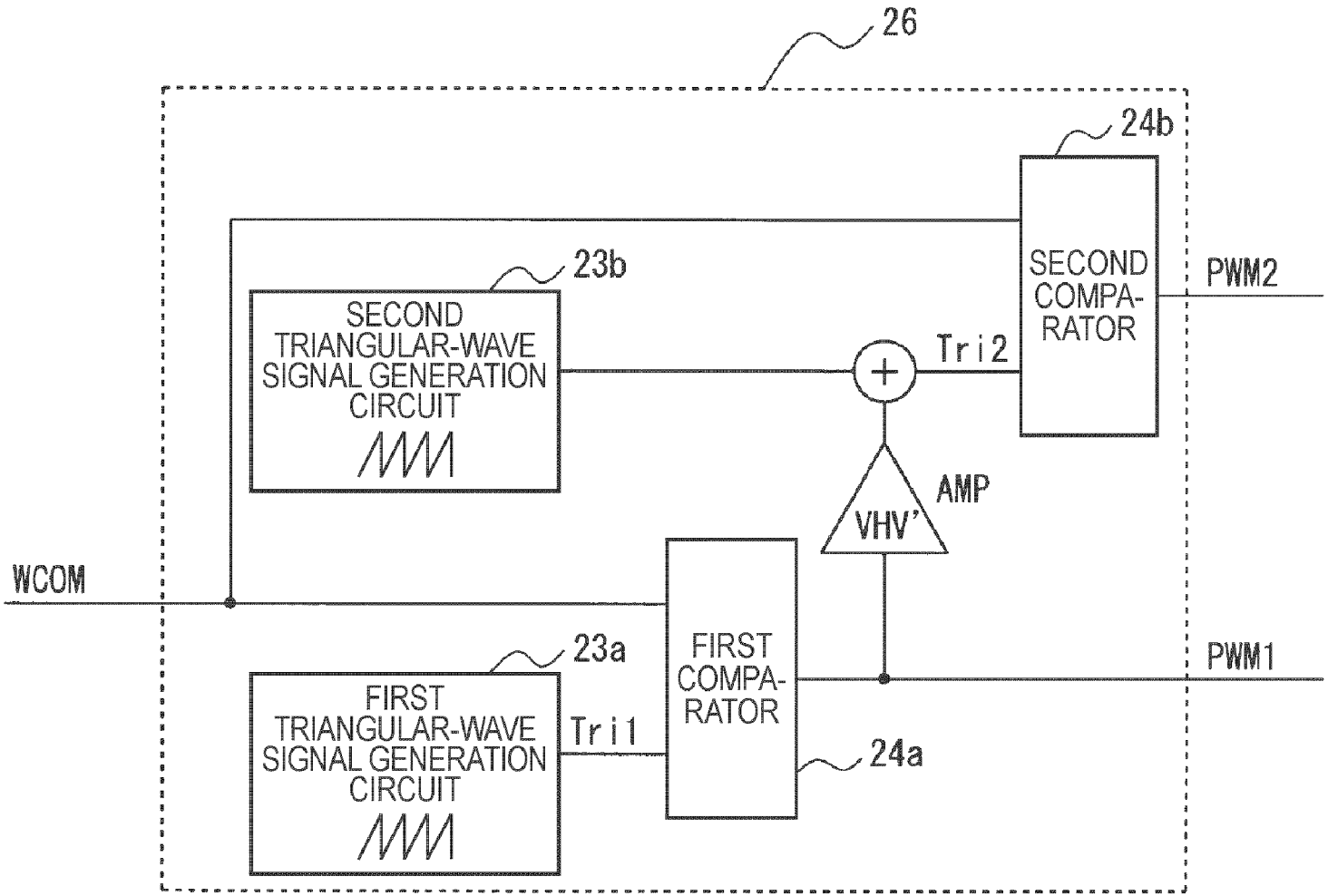
FIG. 15 is a block diagram of a modulator in the second embodiment.
Figure 16:
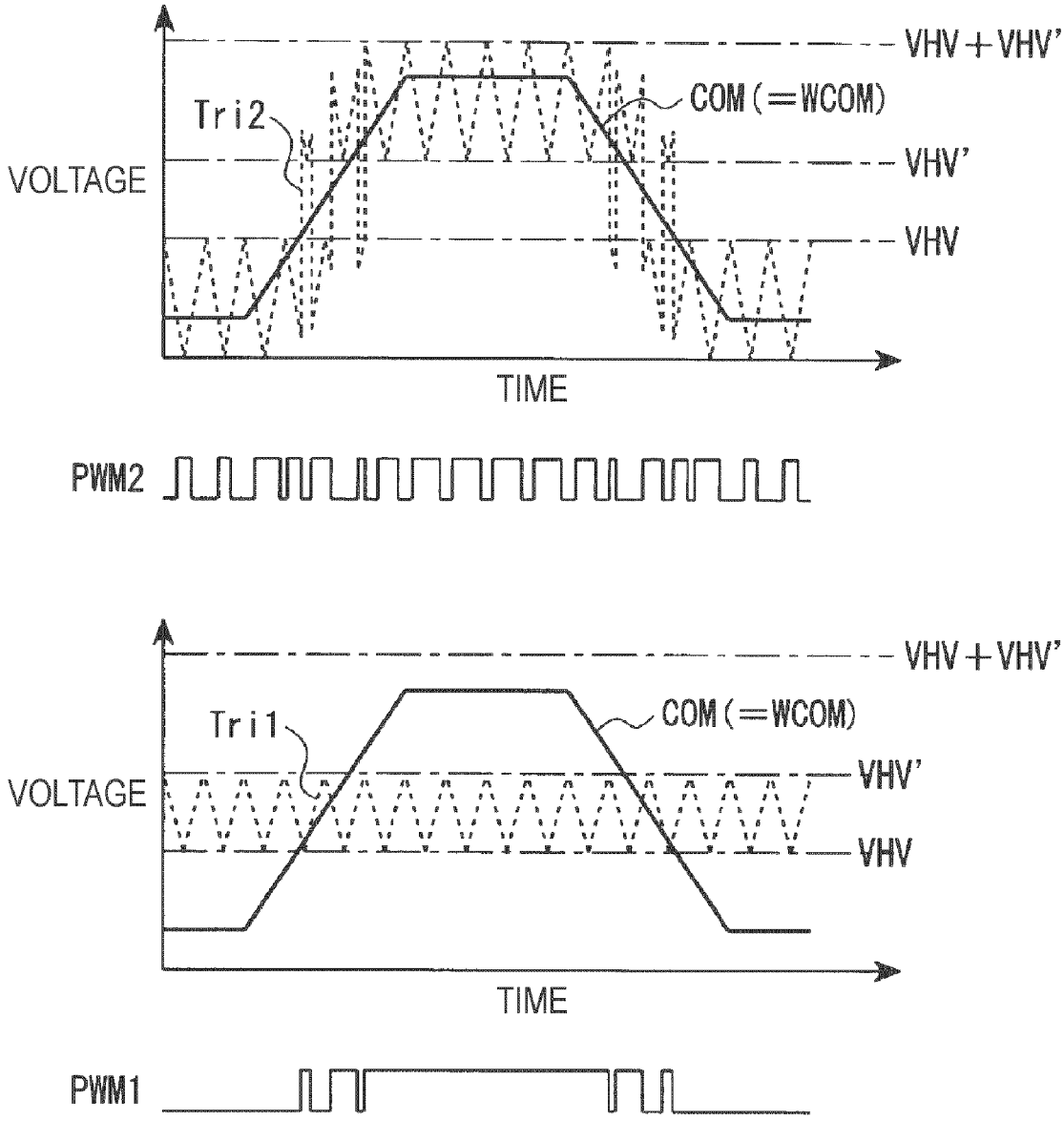
FIG. 16 is an explanatory diagram of triangular-wave signals employed in the second embodiment.

FIG. 15 is a block diagram of the modulator 26 employed in the drive signal output circuit of the second embodiment. In the second embodiment, two triangular-wave signal generation circuits of a first triangular-wave signal generation circuit 23*a* and a second triangular-wave generation circuit 23*b* are included. When the drive waveform signal WCOM is, as shown in FIG. 16, identical to the drive signal COM, the first triangular-wave signal generation circuit 23*a* outputs a first triangular-wave signal Tri1 that varies between the electric potential at the second power supply VHV' and the electric potential at the power supply VHV. The second triangular-wave signal generation circuit 23*b* outputs a second triangular-wave signal Tri2 that varies between the zero electric potential and the electric potential at the power supply VHV. The modulation frequencies of the first and second triangular-wave signals are identical to each other.

The first triangular-wave signal Tri1 outputted from the first triangular-wave signal generation circuit 23*a* is compared with the drive waveform signal WCOM by a first comparator 24*a*. A first modulated signal PWM1 that when the drive waveform signal WCOM has a larger electric potential value than the first triangular-wave signal Tri1 does, enters the on-duty thereof is outputted. Only when the first triangular-wave signal Tri1 is in the on-duty thereof, the second triangular-wave signal Tri2 outputted from the second triangular-wave signal generation circuit 23*b* is biased with the electric potential at the second power supply VHV' by an amplifier AMP. The resultant output signal is compared with the drive waveform signal WCOM by a second comparator 24*b*. A second modulated signal PWM2 that when the output signal has a larger electric potential value than the drive waveform signal WCOM does, enters the on-duty thereof is outputted. Namely, the first triangular-wave signal Tri1 causes the drive waveform signal WCOM to be pulse-modulated between the electric potential at the power supply VHV and the electric potential at the second power supply VHV' so that the resultant signal will be outputted as the first modulated signal PWM1. When the second triangular-wave signal Tri2 is not biased with the electric potential at the second power supply VHV', the second triangular-wave signal Tri2 causes the drive waveform signal WCOM to be pulse-modulated between the zero electric potential and the electric potential at the power supply VHV. When the second triangular-wave signal Tri2 is biased with the electric potential at the second power supply VHV', the second triangular-wave signal Tr2 causes the drive waveform signal WCOM to be pulse-modulated between the electric potential at the second power supply VHV' and the sum of the electric potential at the power supply VHV and the electric potential at the second power supply VHV' so that the resultant signal will be outputted as the second modulated signal PWM2.

Figure 17:
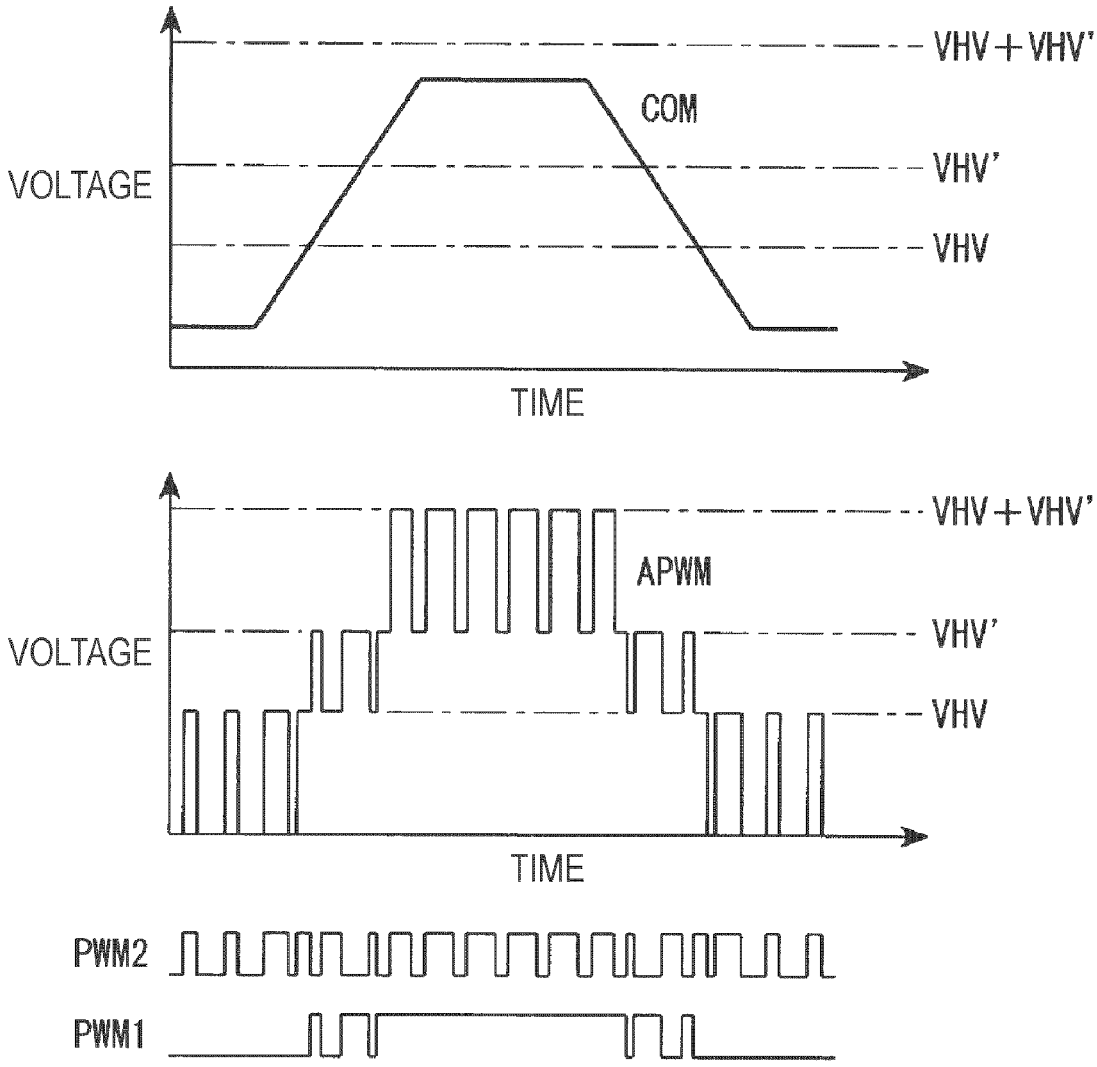
FIG. 17 is an explanatory diagram of an amplified digital signal and a drive signal employed in the second embodiment.

FIG. 17 shows the time-sequential changes in the amplified digital signal APWM produced by amplifying the powers of the first modulated signal PWM1 and second modulated signal PWM2 by the digital power amplification circuit 28 shown in FIG. 14, and in the drive signal COM produced by smoothing the amplified digital signal by the low pass filter 29. In the second embodiment, the amplified digital signal APWM reaches a total of four steps of electric potentials, that is, the zero electric potential, the electric potential at the power supply VHV, the electric potential at the second power supply VHV', and the sum of the electric potential at the power supply VHV and the electric potential at the second power supply VHV'. Namely, the number of steps of electric potentials the amplified digital signal reaches is larger by one than the number of steps of electric potentials in the first embodiment. As the number of steps of electric potentials the amplified digital signal reaches is larger, the efficiency in following a waveform improves and a high-definition drive signal can be produced. In addition, since the electric potential difference between adjoining ones of the steps decreases, the order of the low pass filter 29 can be further lowered. The dielectric strength of the switching elements Q1 and Q2 in each of the digital power amplifiers 27*a* and 27*b* can be decreased.

As mentioned above, according to the liquid jet apparatus of the second embodiment, not only the same advantage as that of the first embodiment is provided but also the amplified digital signal APWM can represent a larger number of values by connecting the digital power amplifiers 27*a* and 27*b* in multiple stages to the power supplies at which the different voltage are developed. The drive signal COM of higher precision can be produced.

In the second embodiment, the number of stages of digital power amplifiers 27*a* and 27*b* in the digital power amplification circuit 28 is two. The number of stages of digital power amplifiers is not limited to two. An advantage to be provided by an increase in the number of stages of digital power amplifiers has been described in relation to the first and second embodiments.

In the first and second embodiments, a description has been made on the assumption that the liquid jet apparatus of the invention is adapted to a line head type printing apparatus. The liquid jet apparatus of the invention can be adapted to a multi-pass type printing apparatus in the same manner.

The liquid jet apparatus of the invention can be embodied as a liquid jet apparatus that jets a liquid other than ink (including, aside from liquids, a liquid substance having particles of a functional material dispersed therein, and a liquid substance such as gel) or a fluid other than liquids (a solid that can be jetted as a fluid). For example, a liquid substance jet apparatus that jets a liquid substance having an electrode material, a color material, or any other material, which is employed in manufacture of a liquid crystal display, an electroluminescent (EL) display, a surface-luminescence display, or a color filter, dispersed or fused therein, a liquid jet apparatus that jets a living organic substance employed in biochip fabrication, or a liquid jet apparatus that is used as a precision pipette to jet liquid which is a specimen will do. Further, a liquid jet apparatus that jets a lubricant by pinpointing a watch, a camera, or any other precision machine, a liquid jet apparatus that jets a fluid of a transparent resin such as an ultraviolet-cured resin, which is used to form a microscopic hemispheric lens (optical lens) to be adapted to an optical communication element or the like, to a substrate, a liquid jet apparatus that jets an acid or alkaline etching solution which is used to etch a substrate or the like, a fluid substance jet apparatus that jets gel, or a liquid jet type recording apparatus that jets a solid, for example, powder such as toner will do. The invention can be adapted to any of the jet apparatuses.

The entire disclosure of Japanese Patent Application No. 2008-006622 filed on Jan. 16, 2008 is expressly incorporated by reference herein.

What is claimed is:

1. A liquid jet apparatus comprising:

a drive waveform generator that generates a drive waveform signal;

a modulator that pulse-modulates the drive waveform signal so as to produce a modulated signal;

a digital power amplification circuit that amplifies the power of the modulated signal so as to produce an amplified digital signal; and a low pass filter that smoothes the amplified digital signal so as to produce a drive signal, wherein:

the digital power amplification circuit includes a plurality of stages of digital power amplifiers each including a pair of switching elements that are push-pull-connected; and the amplified digital signal is a multi-value signal that reaches a larger number of steps of electric potentials than the number of digital power amplifiers.

2. The liquid jet apparatus according to claim 1, wherein the digital power amplification circuit has a bootstrap circuit connected to the digital power amplifier in the second or subsequent stage, and the digital power amplifier in the preceding stage applies a bias voltage.

3. The liquid jet apparatus according to claim 2, wherein a capacitor included in the bootstrap circuit has a capacitance that is large enough to drive actuators.

4. The liquid jet apparatus according to claim 1, wherein the digital power amplifiers in the plurality of stages are connected to the same power supply.

5. The liquid jet apparatus according to claim 1, wherein the digital power amplifiers in the plurality of stages are connected to power supplies at which different voltage are developed.

6. The liquid jet apparatus according to claim 1, wherein the modulator outputs the same number of modulated signals as the number of digital power amplifiers in the plurality of stages.

7. The liquid jet apparatus according to claim 1, wherein the modulator is a pulse-width modulation circuit.

8. The liquid jet apparatus according to claim 1, wherein the modulator is a pulse-density modulation circuit.

9. A printing apparatus that includes a liquid jet apparatus comprising:

a drive waveform generator that generates a drive waveform signal;

a modulator that pulse-modulates the drive waveform signal so as to produce a modulated signal;

a digital power amplification circuit that amplifies the power of the modulated signal so as to produce an amplified digital signal; and a low pass filter that smoothes the amplified digital signal so as to produce a drive signal, wherein:

the digital power amplification circuit includes a plurality of stages of digital power amplifiers each including a pair of switching elements that are push-pull-connected; and the amplified digital signal is a multi-value signal that reaches a larger number of steps of electric potentials than the number of digital power amplifiers.

10. The printing apparatus according to claim 9, wherein the modulator outputs the same number of modulated signals as the number of digital power amplifiers in the multiple stages.

11. The printing apparatus according to claim 9, wherein the digital power amplification circuit has a bootstrap circuit connected to the digital power amplifier in the second or subsequent stage, and the digital power amplifier in the preceding stage applies a bias voltage.

* * * * *